US007025146B2

(12) United States Patent
King et al.

(10) Patent No.: US 7,025,146 B2
(45) Date of Patent: Apr. 11, 2006

(54) ALTERNATIVE PACKER SETTING METHOD

(75) Inventors: James G. King, Kingwood, TX (US); Steve Johnstone, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 276 days.

(21) Appl. No.: 10/744,298

(22) Filed: Dec. 22, 2003

(65) Prior Publication Data

US 2005/0023004 A1 Feb. 3, 2005

Related U.S. Application Data

(60) Provisional application No. 60/436,554, filed on Dec. 26, 2002.

(51) Int. Cl.
*E21B 34/10* (2006.01)
*E21B 33/128* (2006.01)

(52) U.S. Cl. ..... 166/374; 166/376; 166/122; 166/129

(58) Field of Classification Search ..... 166/374, 166/375, 376, 381, 122, 126, 129, 142, 319
See application file for complete search history.

(56) References Cited

U.S. PATENT DOCUMENTS

| | | | | |
|---|---|---|---|---|
| 3,318,384 | A * | 5/1967 | Brown | 166/120 |
| 3,603,388 | A * | 9/1971 | Current et al. | 166/120 |
| 4,258,787 | A | 3/1981 | Amancharia | 166/120 |
| 4,258,792 | A * | 3/1981 | Restarick | 166/378 |
| 4,390,065 | A | 6/1983 | Richardson | 166/181 |
| 4,423,777 | A * | 1/1984 | Mullins et al. | 166/120 |
| 4,432,417 | A | 2/1984 | Bowyer | 166/120 |
| 5,020,600 | A | 6/1991 | Coronado | 166/387 |
| 5,044,444 | A | 9/1991 | Coronado | 166/387 |
| 5,826,652 | A | 10/1998 | Tapp | 166/120 |
| 6,513,599 | B1 * | 2/2003 | Bixenman et al. | 166/378 |
| 6,588,266 | B1 | 7/2003 | Tubel et al. | 73/152.39 |

* cited by examiner

*Primary Examiner*—Frank S. Tsay
(74) *Attorney, Agent, or Firm*—Madan, Mossman & Sriram P.C.

(57) ABSTRACT

Fluid setting pressure is delivered to a hydraulically set well packer through an external conduit strapped to the exterior of a well workstring above the packer assembly. The continuity of the external conduit is continued past the packer assembly by following a flow channel along the mandrel sleeve thickness. Representatively, the external conduit may serve a primary well function other than packer setting (e.g. well chemical delivery). A calibrated rupture element in the external conduit is disposed to initially obstruct external conduit flow past the packer element. Consequently, fluid pressure transferred down the external conduit is first channeled to the packer setting pressure chamber. After setting, the fluid pressure in the external conduit is increased to rupture the calibrated element. When the external conduit flow channel is opened by rupture of the calibrated element, and the additional well service function may be accomplished.

18 Claims, 3 Drawing Sheets

ALTERNATIVE PACKER SETTING METHOD

This application claims the priority of U.S. Provisional Patent Application Ser. No. 60/436,554 filed Dec. 26, 2002.

BACKGROUND OF THE INVENTION

1. Field of The Invention

This invention relates to the art of earth boring and crude petroleum production. More particularly, the invention relates to well annulus packer tools and methods for improving the efficiency of downhole operations 2. Description of Related Art Packers and bridge plugs are devices for sealing the annulus of a borehole between a pipe string that is suspended within the borehole and the borehole wall (or casing wall). Hereafter, the term "packer" will be used as a generic reference to packers, bridge plugs or other such flow channel obstructions. The functional purpose of a packer is to obstruct the transfer of fluid and fluid pressure along the length of a well annulus.

Certain well completion procedures call for a conduit link to the surface independent of a primary workstring flowbore provided by drill pipe or coiled tubing. For example, certain chemical treatments are facilitated by an independent fluid conduit that is externally banded to the workstring as the workstring is lowered into a well. In another example, independent conduits that are externally banded to a workstring may provide hydraulic power fluid circulation conduits for downhole motors and other power tools. Another exemplary use for an external conduit could include a protective tubing sheath for electrical or fiber optic conduit.

When it is necessary to continue the continuity of such an external conduit past or below a packer, it is preferable for the packer construction to provide an internal by-pass channel for the conduit. Hence, the external conduit follows a course between the workstring flowbore and the radially expandable sealing gland of the packer. Above and below the packer sealing gland, connectors are provided for convenient attachment of the external conduit run.

Typically, inflation or compressive expansion of a packer sealing gland is accomplished by a fluid pressure elevation within the workstring flowbore. Such selectively applied fluid pressure within the flowbore is typically applied by closing off the flowbore. This is conventionally accomplished via a wireline conveyed plug, hydromechanical valve, or by setting a "disappearing" plug into the flowbore. Alternatively, the flowbore may be closed off by depositing a bore sealing element such as a dart or ball into the flowbore and either pumping or allowing gravity to carry the sealing element against a bore closure seat below the packer. When the sealing element, for example, a ball, engages the bore closure seat, pump pressure at the surface may be transferred down the flowbore to the packer engagement mechanism. Unfortunately, this procedure leaves the bore obstructed by the sealing element for subsequent operations. Although the obstruction may be avoided or accommodated, the obstruction presence creates additional complications.

Other typical packer expansion techniques include mechanical devices that set the packer seal by rotation or a selective push or pull. Although mechanically set packers are not normally used in conjunction with external conduit due to the angular or linear displacement of the supporting workstring, expansion and rotary transition joints may be used to transcend the obstacles thereby facilitating use of the invention to activate or operate other downhole tools such as valves in conjunction with mechanically set packers.

A system has been used previously that utilized an external fluid conduit safety valve line to actuate a packer as well as to close the safety valve. In this system, the safety valve was located uphole from the packer, and both the packer and safety valve were located relatively close to the surface (i.e., within a few hundred feet). This system used a relief valve that opened to set the packer after the safety valve was closed. Aside from this system, however, it has not been generally known to actuate a packer assembly using an external conduit that is used for chemical injection, motor control, or other independent well service function.

SUMMARY OF THE INVENTION

An object of the present invention is a method for engaging a well packer in a workstring that carries an external conduit without obstructing the workstring flow bore.

Another object of the invention is provision of an apparatus that will permit dual use of a well workstring that supports an external conduit.

A further object of the invention is a dual use utility of an external conduit for hydraulically setting a packer and thereafter using the same external conduit for a separate or independent purpose.

Also an object of the invention is the capacity to set a fluid pressure actuated appliance in a well service string that carries an external conduit without obstructing the service string flow bore.

These and other objects of the invention as will be apparent from the detailed description to follow are realized from an external conduit secured to a well service string for an independent well service function. The external conduit may be obstructed to fluid flow by a calibrated rupture element a point downhole of a fluid flow junction for a conduit that is also connected to fluid pressure actuated appliance such as a packer. The independent function of the external conduit may be as a well treating chemical carrier or as a conduit for hydraulic power fluid. An external service conduit, usually routed through a packer mandrel, provides flow continuity past a packer gland for the external conduit between the uphole and downhole ends of the pipe string that supports the packer joint. The methods and device of the present invention permit such dual use operation even where the packer and other independent well service function are located thousands of feet below the surface of the well.

Well working circumstances giving rise to the necessity and use of such equipment may be simplified by a junction connection of the packer service conduit with a shunt conduit to the packer actuation chamber. Downstream of the junction connection, the service conduit or external conduit is closed; preferably by a pressure-relieved obstruction such as a rupture disc or pressure displaced piston valve.

When the well workstring is positioned as required, the packer is actuated by a pressure increase within the external conduit. Preferably, the packer actuation chamber is protected by a pressure responsive closure valve that closes the packer actuation chamber to fluid pressure above a predetermined value.

A fluid pressure increase in the external conduit above the packer setting pressure ruptures a calibrated disc or membrane thereby opening the pressure relieved obstruction and permitting the primary or independent use of the external conduit.

BRIEF DESCRIPTION OF DRAWINGS

For a thorough understanding of the present invention, reference is made to the following detailed description of the preferred embodiments, taken in conjunction with the accompanying drawings in which like reference characters designate like or similar elements throughout the several figures of the drawing.

DESCRIPTION OF THE PREFERRED EMBODIMENTS

Figure 1:
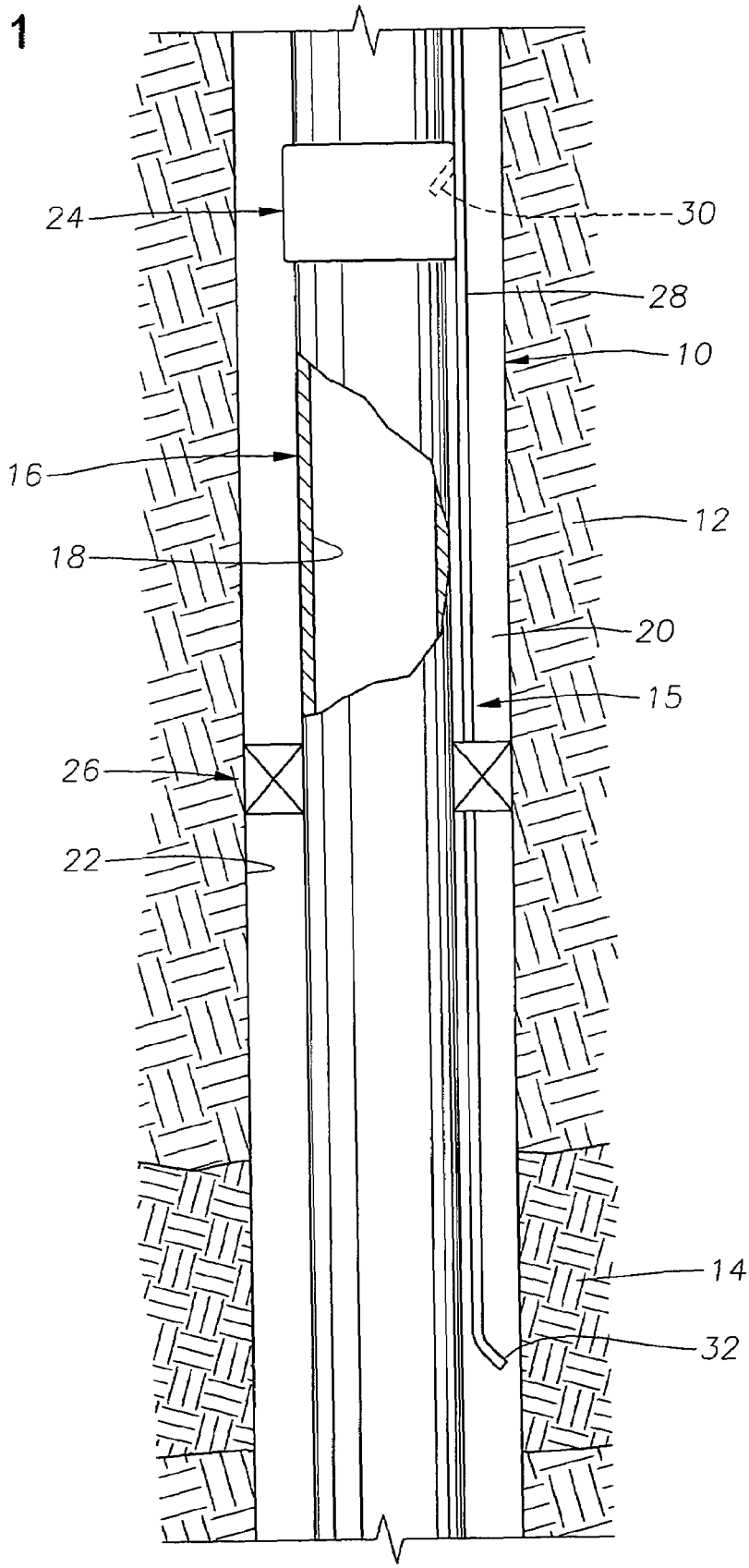
FIG. 1 is a schematic side, cross-sectional view of an exemplary wellbore containing a production assembly in accordance with the present invention with a packer device, safety valve and chemical injection system.

FIG. 1 shows an exemplary wellbore 10 that has been drilled through the earth 12 to a hydrocarbon-producing formation 14. In this instance, the formation 14 is in a late stage of its life and requires chemical injection treatment to assist continued production of hydrocarbons therefrom. A production assembly 15 is incorporated into a production string 16, which is disposed within the wellbore 10, extending downwardly from the surface (not shown) of the wellbore 10. The production tubing string 16 defines an interior fluid flowbore 18 axially along its length. As is known in the art, the production tubing string 16 is made up of a series of production tubing sections that are secured in an end-to-end fashion. An annulus 20 is defined between the outer surface of the production tubing string 16 and the interior wall 22 of the wellbore 10.

A number of subs and tools may be incorporated into the production tubing string 16, as is well known. The production tubing string 16 includes a hydraulically-actuated subsurface safety valve 24 that is operable to close off flow of fluid through the interior fluid flowbore 18 upon actuation. Incorporated within the production tubing string 16 below the safety valve 20 is a packer assembly 26 for sealing off the annulus 20 against fluid flow and securing the production tubing string 16 within the wellbore 10. The packer assembly 26 is shown in an unset, or running, position in FIG. 1. The structure and operation of the packer assembly 26 will be described in greater detail shortly.

An external fluid conduit 28 is disposed within the annulus 20 extending from the surface of the wellbore 10. The external fluid conduit 28 is secured to the outer surface of the production tubing string 16 along its length by banding or the like. The fluid conduit 28 is operably interconnected (see fluid port 30) with the safety valve 24 for the delivery of fluid used to actuate the valve 24. The fluid conduit 28 also passes through the packer assembly 26, in a manner that will be described in greater detail shortly. The lower end 32 of the fluid conduit 28 provides a fluid outlet that is disposed proximate the formation 14 for delivery of chemical injection fluid to the formation 14.

Figure 2:
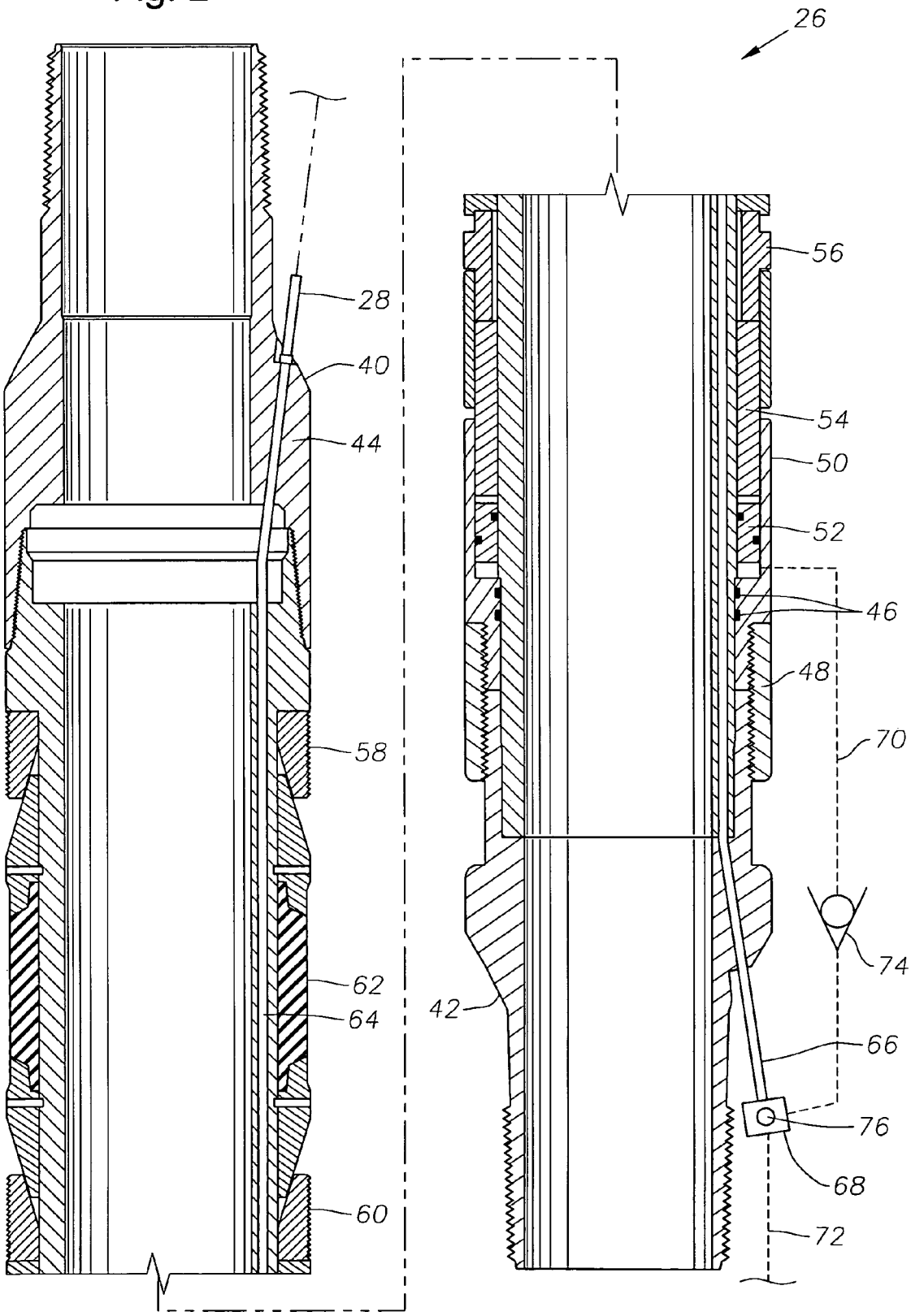
FIG. 2 illustrates the quarter section of a hydraulically set packer having an external conduit by-pass in accordance with the present invention.

Referring to FIG. 2, the packer assembly 26 is shown in greater detail and apart from the other components of the production tubing string 16. The packer assembly 26 includes a sealing element and an anchor slip mechanism between an upper collar 40 and a lower collar 42. Secured between and to each of the collars is a tubular mandrel 44. A cylindrical tube 46 has a sliding seal fit against the outer surface of the mandrel 44 but is immovably secured to the lower collar 42 by an assembly ring 48 having a threaded connection to both, the lower collar 42 and the cylindrical tube 46.

A cylinder wall extension 50 from the cylindrical tube base has a greater inside diameter than the mandrel outside diameter to create an annular cylinder chamber 52 between the concentrically facing wall surfaces. Slidably disposed within the cylinder chamber 52 is an actuating piston 54. The outer face of the piston 54 bears against an actuating ram 56.

In sliding assembly between the actuating ram 56 and an abutment ledge on the upper collar 40 is a set of upper anchor slips 58, a set of lower anchor slips 60 and a packer sealing element 62.

Operatively, fluid pressure admitted to the cylinder chamber 52 displaces the actuating piston 54 against the ram 56. Force of the displaced ram 56 compressively collapses the expanded slip and seal assembly to radially expand the anchor slip elements and the seal element against a casing or wellbore wall.

The external conduit 28 is connected to a by-pass service conduit 64 bored within the structural annulus of the mandrel 44. A lower conduit sub 66, connected to the lower outlet of the by-pass service conduit 64, is also connected to a calibrated rupture element 68.

The rupture element 68 has, for example, three flow ports: an inlet port connected to the lower conduit sub 66; a secondary outlet port connected to a packer setting shunt conduit 70; and a primary outlet port connected to the external conduit extension 72. Specifically, the packer setting shunt conduit 70 is connected to the packer actuating chamber 52. The flow channel of the shunt conduit 70 may also include a check valve 74 oriented to prevent reverse flow of fluid from the shunt conduit 70. An open flow channel within the rupture element 68 links the inlet port 66 with the shunt conduit 70.

Also within the rupture element 68, is a calibrated flow barrier (rupture disc 76) between the inlet port 66 and the primary outlet port 72 that prevents fluid flow into the outlet port 72 until ruptured by a predetermined increase of pressure differential across the rupture element 68.

In operation, the production tubing string 16 is provided with the external fluid conduit 28 for delivery of well treatment chemical and is positioned at the desired well depth for setting of the packer assembly 26. Setting is caused by a first fluid pressure delivery of hydraulic fluid along the fluid conduit 28. As the fluid pressure charge emerges from the mandrel by-pass conduit 64 into the rupture element 68, the flow barrier 76 within the rupture element blocks the line flow from continuing along the primary external line 72. Such flow is initially directed into the shunt conduit 70. From the shunt conduit 70, the pressurized fluid enters the pressure chamber 52 to drive the actuating piston 54 against the actuating ram 56. Longitudinal displacement of the actuating ram 56 displaces the slips 58 and 60 radially outward to anchor the packer assembly 26 within the wellbore 10. Continued compression of the packer assembly 26 expands the perimeter of the packer seal element 62 against the well wall 22 for isolation of the well annulus 20.

In some cases, the shunt conduit 70 enters the pressure chamber 52 through a pressure limiting valve not shown. At a predetermined elevated pressure, the pressure limiting valve closes permanently to isolate the pressure chamber 52 from extreme pressure spikes.

Also at a predetermined pressure above the packer setting pressure, the flow barrier 76 in the rupture element 68 fails by a physical rupture. This rupture opens a direct flow channel from the lower conduit sub 66 into the external extension conduit 72. Fluid within the pressure chamber 52 is isolated by the pressure limiting valve and/or the shunt conduit check valve 74. Alternatively, the flow barrier 76 of the rupture element 68 may be ruptured by causing multiple cycles of pressure increases. Such a device might incorporate a bellows or an indexing mechanism which "counts" a number of pressure increase cycles before allowing fluid communication to begin.

Shunt conduit 70 and rupture element 68 are illustrated as dashed lines routed externally of the packer assembly body. This format is used for disclosure clarity. Those of ordinary skill will understand that the shunt conduit 70 and/or the rupture element 68 may be fabricated internally of either collar 40 or 42. The shunt conduit 70 may be extended along the mandrel 44 laterally of the by-pass conduit 64.

Once the packer assembly 26 is set, as described above, production stimulation chemicals are then pumped down the external fluid conduit 28 where they flow past the now set packer assembly 26 and exit the fluid outlet at lower end 32 where it commingles with the produced fluid within the lower portion of the wellbore 10. The presence of the chemicals in the lower portion of the wellbore 10 helps to stimulate production from the formation 14. Thus, it can be seen that the external fluid conduit 28 of the production assembly 15 provides a dual use in that it both sets that packer assembly 26 and is subsequently used for chemical stimulation of the formation. Additionally, the external fluid conduit 28 may be used to actuate the safety valve 24, if necessary, by selectively directing fluid flow into the fluid inlet 30.

Figure 3:
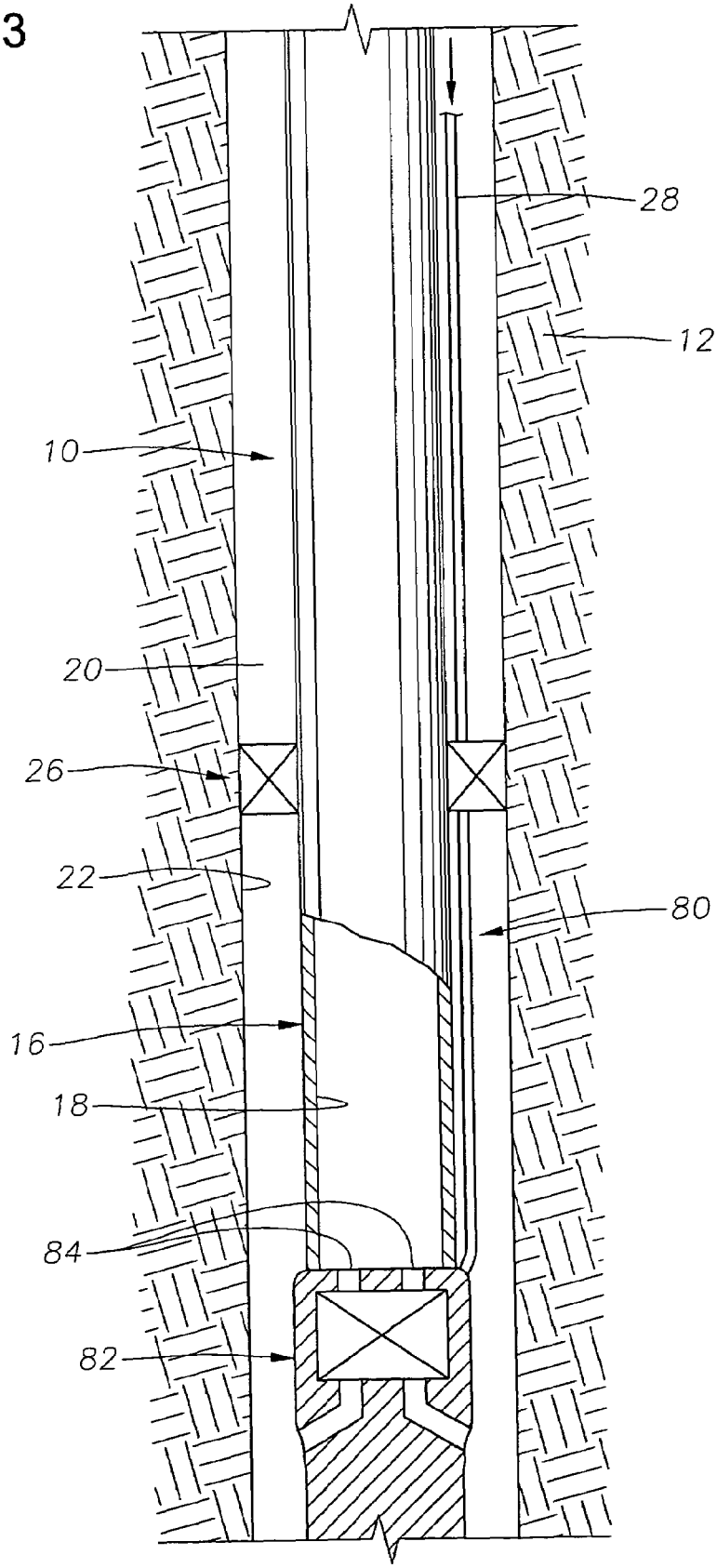
FIG. 3 is a schematic side, cross-sectional view of an exemplary wellbore containing a production assembly in accordance with the present invention having a packer device and downhole motor.

Referring now to FIG. 3, there is shown an alternative production system 80 that is constructed in accordance with the present invention. In this system, the production tubing string 16 is provided with a packer assembly 26 and a hydraulically-actuated fluid pump 82. A subsurface safety valve, such as the safety valve 24 described earlier, may or may not be present. The pump 82 is provided with a plurality of fluid inlets 84 for the intake of production fluid from the annulus 20 that is to be transmitted upwardly through the interior flowbore 18 of the production tubing string 16. The external fluid conduit 28 is operatively associated with the fluid pump 82 to supply hydraulic fluid that will operate the pump 82. The spent hydraulic fluid may be either expelled into the wellbore 10 or returned to the surface of the wellbore via a return fluid conduit (not shown). In operation, the pump 82 will draw fluid into the inlets 84 and pump it upward toward the surface of the wellbore 10.

The production assembly 80 is operated to first set the packer assembly 26, as described previously. When set, a second, greater level of fluid pressure is applied within the external fluid conduit 28 to supply hydraulic fluid to the pump 82 for operation of the pump 82. The production assembly 80 is, therefore, also provided with an external fluid conduit that is capable of dual operable purposes within the wellbore 10.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A subterranean well service string having an internal fluid flow bore, a fluid pressure actuated appliance therein and an external fluid conduit secured to said service string for serving an independent well service function, said external conduit having a calibrated rupture element obstructing fluid flow continuity downhole of said rupture element and a junction conduit uphole of said rupture element, said junction conduit having a fluid transfer connection with said fluid pressure actuated appliance.

2. A well service string as described by claim 1 wherein said fluid pressure actuated appliance is a well packer.

3. A well service string as described by claim 2 wherein said well packer is engaged by fluid pressure within said junction conduit.

4. A well service string as described by claim 1 wherein said calibrated rupture element opens said external conduit for fluid flow downhole of said rupture element at a fluid pressure above a calibrated threshold.

5. A well service string as described by claim 1 wherein said calibrated rupture element opens said external conduit for fluid flow downhole of said rupture element upon multiple cycles of fluid pressure increase.

6. A subterranean well packer having an internal fluid flow bore and a by-pass conduit for upstream-to-downstream communication continuity of an external conduit past a wellbore sealing element actuated by fluid pressure, said by-pass conduit having a selectively removed flow obstruction and a fluid transfer junction upstream of said obstruction into a sealing element actuating chamber.

7. A subterranean well packer as described by claim 6 wherein said selectively removed flow obstruction is a pressure responsive element.

8. A subterranean well packer as described by claim 7 wherein said pressure responsive element is a pressure ruptured element.

9. A subterranean well packer as described by claim 7 wherein said pressure responsive element is a pressure displaced piston.

10. A subterranean well packer comprising a tubular mandrel having a workstring flowbore therein, an expandable wellbore sealing element disposed about said mandrel, a fluid pressure chamber for actuating said sealing element and an upstream-to-downstream fluid service conduit contiguous with said mandrel disposed between said flowbore and said sealing element, the improvement comprising: a selectively opened fluid flow barrier in said service conduit and a shunt conduit between said pressure chamber and said service conduit, said shunt conduit connected to said service conduit upstream of said flow barrier.

11. A subterranean well packer as described by claim 10 wherein said selectively opened flow barrier is a fluid pressure displaced conduit obstruction.

12. A subterranean well packer as described by claim 11 wherein said flow barrier is a pressure ruptured flow obstruction.

13. A subterranean well packer as described by claim 11 wherein said flow barrier is a pressure displaced piston element.

14. A subterranean well packer as described by claim 10 wherein said shunt conduit includes a check valve between said service conduit connection and said pressure chamber.

15. A method of setting, by fluid pressure in an actuation chamber, a subterranean well packer secured within a well workstring having a central flowbore and an external fluid service conduit, said method comprising the steps of: providing a flow obstruction in said service conduit for running said workstring into a well; providing a fluid shunt connection between said service conduit and said actuation chamber; pressurizing said service conduit to a first value to set said packer; and, pressurizing said service conduit to a second value to remove said flow obstruction.

16. A method of setting a subterranean well packer as described by claim 15 wherein a first fluid is provided in said service conduit to set said packer and a second fluid is provided to remove said obstruction.

17. A method of setting a subterranean well packer as described by claim 15 wherein said flow obstruction is removed by a material rupture of said obstruction.

18. A method of setting a subterranean well packer as described by claim 15 wherein said flow obstruction is removed by pressure displacement of a piston element.

* * * * *